US005472359A

United States Patent [19]

Allbright, Jr. et al.

[11] Patent Number: 5,472,359

[45] Date of Patent: Dec. 5, 1995

[54] ENCLOSED SHAFT SYSTEM FOR MARINE JET PROPULSION DRIVES

[75] Inventors: Eddie Allbright, Jr., Covington, La.; James Stewart, Poplarville, Miss.; Bert Schmidt, Mandeville, La.

[73] Assignee: Marine Power, Inc., Ponchatula, La.

[21] Appl. No.: 318,284

[22] Filed: Oct. 5, 1994

[51] Int. Cl.[6] ..... B63H 11/00

[52] U.S. Cl. ..... 440/38; 440/88

[58] Field of Search ..... 440/38, 88, 112; 384/478

[56] References Cited

U.S. PATENT DOCUMENTS

| | | | |
|---|---|---|---|
| 3,177,841 | 4/1965 | Galuska | 440/112 |
| 4,861,294 | 8/1989 | Ousley, II | 440/112 |
| 5,372,526 | 12/1994 | Ozawa et al. | 440/38 |

*Primary Examiner*—Jesus D. Sotelo
*Attorney, Agent, or Firm*—Joseph T. Regard, Ltd.

[57] ABSTRACT

An enclosed shaft system for tunnel jet drive marine propulsion systems for providing an improved lubrication and coolant system over current designs. The preferred embodiment of the present invention contemplates the utilization of an enclosed shaft system wherein the drive propeller drives a portion of the water passing through the tunnel drive through a water intake, which water is filtered and directed to a "T" fitting, wherein a portion of the water is directed to the engine for cooling, and the remaining water is directed to the base of the shaft housing, wherein the water passes through an shaft sleeve enveloping the shaft, the shaft sleeve terminating at an open end wherein the cutlass bearing and propeller is fitted. The water passing through the shaft sleeve both lubricates the cutlass bearings, as well as cooling same. Besides improving the overall performance of the shaft system and decreasing maintenance, the present system has been found to allow for utilization in environments which might be considered to harsh for conventional jet tunnel drive marine propulsion systems, which traditionally have had open shafts, and which traditionally have relied upon the tunnel drive water flow, driven by the propeller, for lubricating and cooling the cutlass bearings.

3 Claims, 2 Drawing Sheets

ENCLOSED SHAFT SYSTEM FOR MARINE JET PROPULSION DRIVES

BACKGROUND OF THE INVENTION

Invention Field

The present invention relates to marine jet propulsion systems, and in particular, to an enclosed shaft system for tunnel jet drive marine propulsion systems, for providing an improved lubrication and coolant system over current designs.

The preferred embodiment of the present invention contemplates the utilization of an enclosed shaft system wherein the drive impeller drives a portion of the water passing through the tunnel drive through a water intake, which water is filtered and directed to a "T" fitting, wherein a portion of the water is directed to the engine for cooling, and the remaining water is directed to the base of the shaft housing, wherein the water passes through an shaft sleeve enveloping the shaft, the shaft sleeve terminating at an open end wherein the cutlass bearing and impeller is fitted. The water passing through the shaft sleeve both lubricates the cutlass bearings, as well as cooling same.

Besides improving the overall performance of the shaft system and decreasing maintenance, the present system has been found to allow for utilization in environments which might be considered to harsh for conventional jet tunnel drive marine propulsion systems, which traditionally have had open shafts, and which traditionally have relied upon the tunnel drive water flow, driven by the propeller, for lubricating and cooling the cutlass bearings.

Unlike the known prior art systems, the present invention allows for the filtration of the water utilized for cooling and lubricating the cutlass bearings and shaft. Thus, in environments such which might have high particulate, such as chopped vegetation or sand, performance which is unhindered by the particulate, unlike the prior art, which has an open circulation system through the cutlass bearings and the propeller, which could trap particulate, damaging the bearings and overheating same.

Lastly, the present system provides improved performance of tunnel jet drive systems, in that the drive shaft of the present invention is sheathed and thereby removed from the flow of the tunnel drive passgage. Accordingly, vegitation such as seaweed and grass are prevented from wrapping around the rotating driveshaft and fouling same, unlike the prior art.

GENERAL BACKGROUND DISCUSSION

While the prior art has contemplated the utilization of the impeller in a jet tunnel drive marine engine, none are known to have contemplated such a system with an enclosed coolant system which reduces cavitation about the rotating drive shaft by providing an enveloping drive shaft cover, while providing a system for circulating filtered coolant water through the area between the drive shaft housing and drive shaft, through the cutlass bearing, and out via the impeller.

In the known prior art systems for jet tunnel drive marine engines, there was provided an open circulation system through the cutlass bearings, wherein the circulation of water through the drive tunnel would provide sufficient flow to force water through the cutlass bearings supporting the impeller and drive shaft coupling. This method of utilizing unfiltered water straight from the drive flow has been found to needlessly reduce the life of the cutlass bearings, which would trap particulate, damaging the bearings and overheating them.

Lastly, the known prior art tunnel drive systems had the rotating drive shaft exposed in the tunnel drive flow stream, wherein it would often encounter grass or seaweed, which would wrap around the drive shaft, fouling same.

SUMMARY DISCUSSION OF THE INVENTION

The present invention overcomes these prior art problems by providing a drive shaft housing and apparatus therefore which is configured to provide a filtered, constant flow of coolant water about the drive shaft and through the cutlass bearings while the cutlass bearings and drive shaft are in operation, which system is highly reliable, relatively economical and of low maintenance.

The preferred embodiment of the present invention contemplates a unitary, one piece housing structure which may be of a single cast structure utilizing, for example, aluminum, fabricated via the lost foam cast method. The housing as configured supports the impeller and drive shaft, while enveloping and thereby protecting said drive shaft, as well as providing a path for the tunnel drive flow. In addition, the housing is also configured to provide a unique configuration for utilizing the positive pressure field created by the rotating impeller, to force water into a coolant flow system, filtering said water and directing a portion of said water about the enveloped drive shaft, and through the cutlass bearings supporting the impeller, as well as directing the remaining flow to the engine for cooling same.

The housing as configured has formed therein an enveloping drive shaft housing having first and second ends, which drive shaft housing passes through the tunnel drive passage to the impeller. The system is configured such that the first end of said housing has supported therein, in the preferred embodiment of the present invention, a double roller thrust bearing with a mechanical seal, thereby sealing the first side of the housing. The second end of the housing has supported therein, just before the impeller, a set of cutlass bearings for supporting the drive shaft.

Juxtaposed between the first and second ends of the drive shaft housing is a filtered water coolant intake, which is configured to force coolant water about the drive shaft, between the void between the drive shaft housing and the drive shaft, the water flowing towards and through the cutlass bearings, thereby cooling and lubricating same.

The coolant water is forced into flow via the action of the impeller, which generates a high pressure area during rotation, forcing a portion of the water flowing therethrough up and through an adjacent set of coolant intake apertures, wherein the water is filtered via screen filter or the like, and directed to the drive shaft housing and engine.

It is thus an object of the present invention to provide an effective system for reducing the wear of the impeller bearing in a marine jet tunnel drive system.

It is another object of the present invention to provide a system for preventing clogged cutlass bearings in a marine jet tunnel drive system.

Further, it is an object of the present invention to provide a system for housing a drive shaft through a marine jet tunnel drive passage, reducing cavitation and increasing efficiency.

It is another object of the present invention to provide a single, unitary, one piece drive shaft/marine jet tunnel drive passage housing, which also includes coolant intake and filtering means, as well as drive shaft and impeller cutlass bearing coolant and lubrication means.

Lastly, it is an object of the present invention to provide a system for providing a positive pressure flow for providing filtered coolant water for a marine propulsion system and drive shaft, utilizing the positive flow provided by a rotating impeller.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
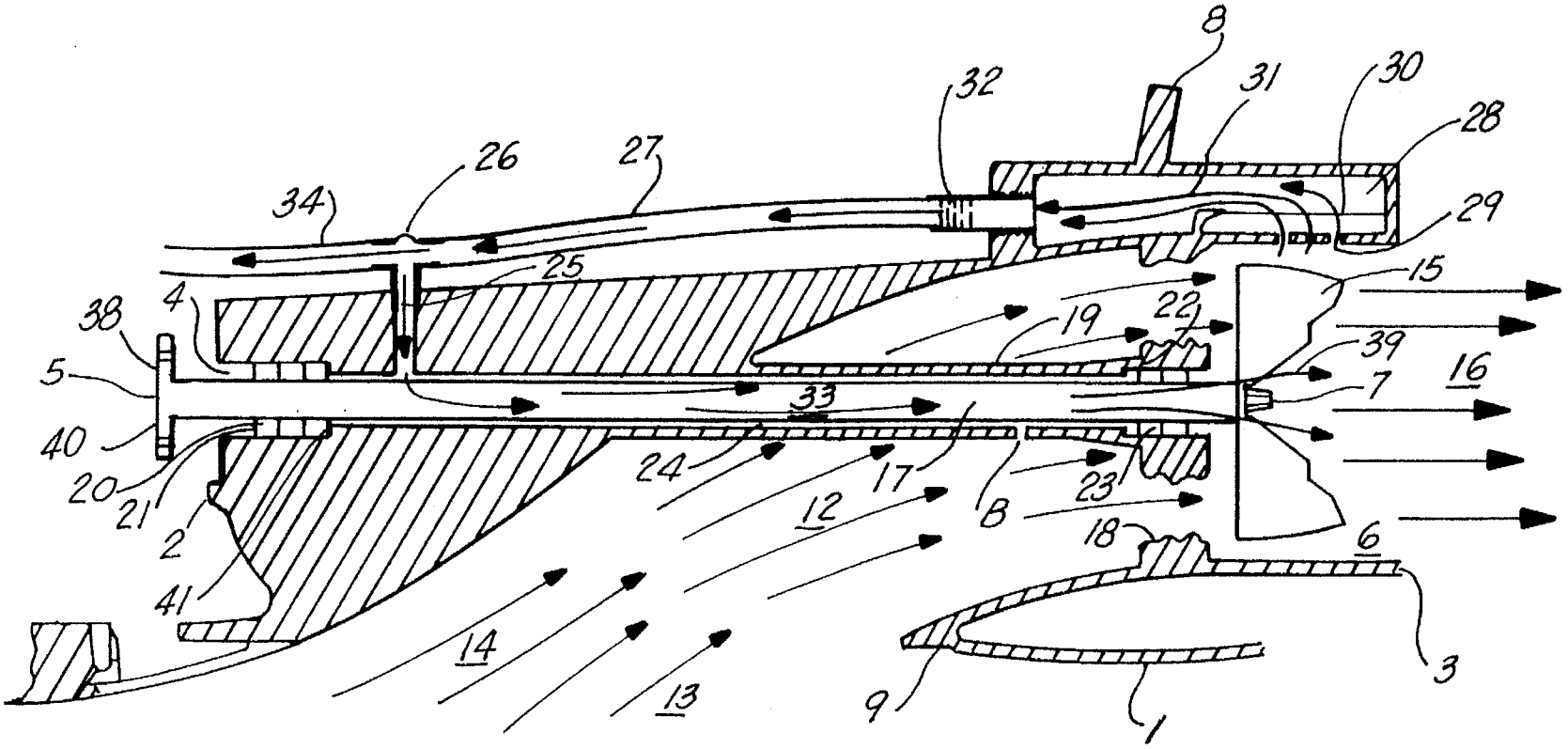
FIG. 1 is a cross-sectional view of the preferred embodiment of the enclosed shaft system of the present invention, illustrating the thrust flow of water through the tunnel drive passage, as well as the flow of coolant water as it is directed from the vicinity of the impeller, through the coolant passage aperture.
Figure 2:
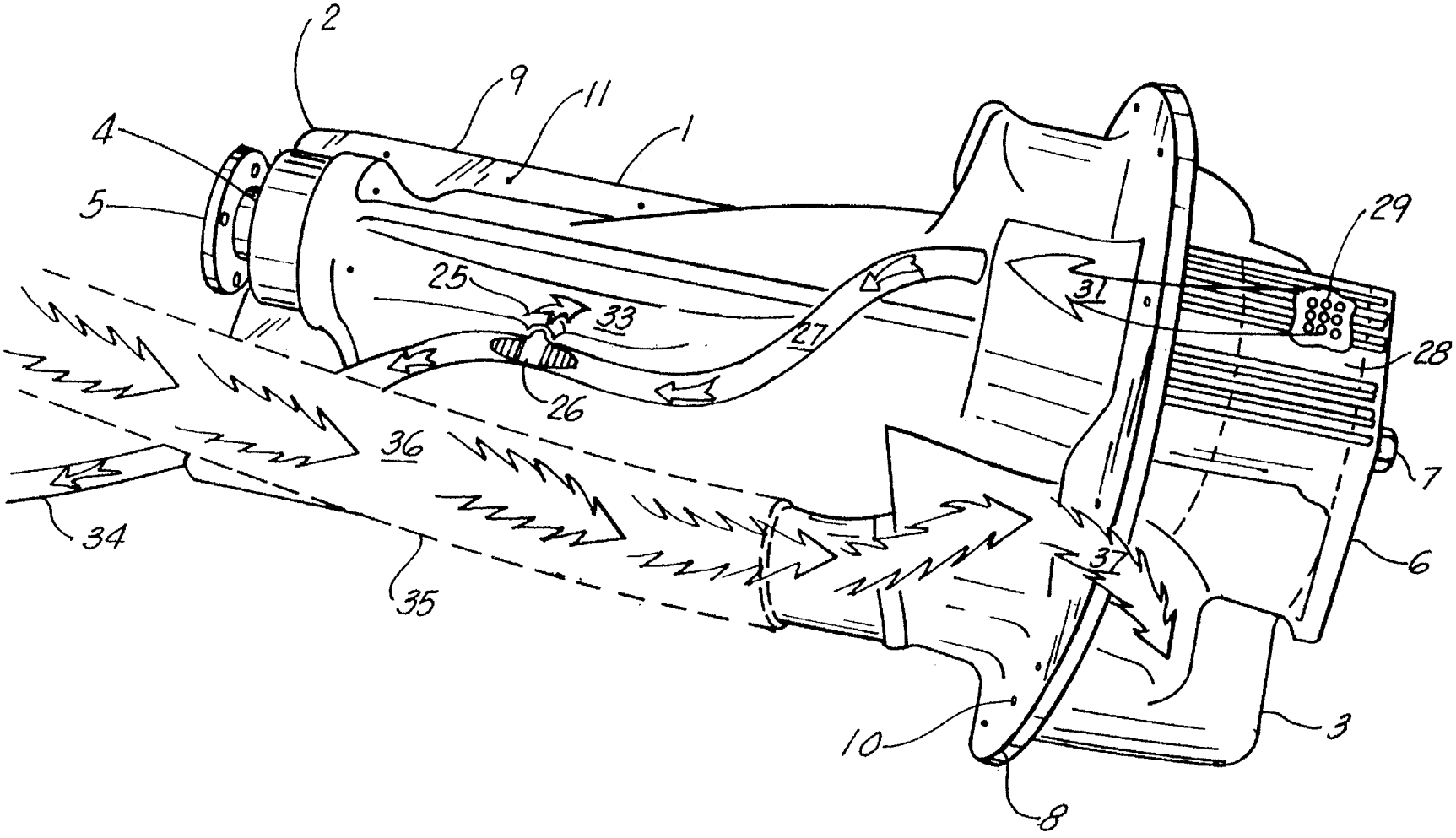
FIG. 2 is an isometric, partially cut-away view of the one piece, unitary housing of the present invention, illustrating the flow configuration of filtered coolant water through the system, as well as the exit exhaust flow.

As shown in FIGS. 1 and 2, the preferred embodiment of the present invention teaches a housing 1 having first 2 and second 3 ends, the first end having formed therethrough, in general longitudinal alignment therewith, a drive shaft passage 4 through which passes a drive shaft 5, the second end having formed therein an impeller cavity 6. The drive shaft 5 has first 38 and second 39 ends, the first end having provided thereon a power shaft mounting arrangement 40, the second end having provided thereon an impeller mounting arrangement, which might be in the form of a threaded bolt 7, affixing an impeller 15 in place in the impeller cavity 6.

There is further included near the second end of the housing a transom mount 8, which would allow the housing to be sealingly affixed to the transom of a watercraft, via, for example, mounting apertures 10, and a floor mount 9 (FIG. 2), which may be sealingly mounted via mounting apertures 11 (FIG. 2).

Referring to FIG. 1, the housing 1 of the present invention further has formed therein a tunnel drive passage 12, running generally from an opening 13 formed within the perimeter of the floor mount 9, to allow the passage of water therethrough, the tunnel drive passage joining with the impeller cavity 6, the tunnel drive passage 12 passing through the area of the transom mount 8, and through the impeller cavity 6, out of the system.

As shown, the drive shaft 5 passes through the drive shaft passage 4, and is configured to pass through 17 the vicinity of the tunnel drive passage, wherein it is sealingly enveloped via shaft housing 19 formed in the housing 1. In the vicinity of the impeller cavity 6, the shaft has provided therein supports 18, configured to provide nominal turbulence during fluid flow through the tunnel drive passage.

Suspending the drive shaft within the drive shaft passage near the first end 38 of said drive shaft is a roller thrust bearing arrangement 20, provided in a thrust bearing cavity 21 formed in the housing. In the preferred embodiment of the present invention, the roller thrust bearing arrangement further includes a mechanical seal 41, effectively fluidly sealing the drive shaft passage 4.

Suspending the drive shaft within the drive shaft passage near the second end 39 of said drive shaft is a cutlass bearing arrangement 22, situated in a cutlass bearing cavity 23 formed in the housing about the drive shaft passage. Preferably, the cutlass bearings 22 should be of an open-flow type, allowing the free flow of fluids therethrough.

The present invention is provided with a means of cooling the cutlass bearings via filtered fluid flow. Referring further to FIG. 1, formed in the housing 1 near the impeller cavity 6 is flow chamber 28, which is configured to receive water from the impeller cavity 6 via flow apertures 30 formed in the wall between the flow chamber and impeller cavity. With the present system, the apertures can be, for example, 13 apertures of 0.25 inch diameter.

The rotating impeller 15 creates a positive pressure area in the vicinity of the impeller cavity, forcing water into the flow chamber 28 via flow apertures 29. Disposed within said flow chamber 28 may be a filter screen 30 or the like, filtering water flowing 31 therethrough. The filter screen 30 may have a filtering size of, for example 50 microns to capture sand and organic matter having a size of greater than 50 microns, for example. During idle, the present impeller may have an RPM rate of, for example, 400, creating a cooling system flow 31 pressure of about, for example, two pounds, while, during full throttle, the impeller may rotate at 2500–4000 rpm upwards, generating a positive pressure flow through the apertures and cooling system of the present invention of about 25 pounds.

From the flow chamber 28, the filtered coolant water may be filtered via line filter 32, passing through hose 27 to a T fitting 26 which is configured to split the flow to hose 34, which runs to the engine for cooling, and passage 25, formed in the housing and running to the drive shaft passage 4. The flow passing into drive shaft passage 4 is cannot pass through the mechanical seal 41 at the first end, so it must travel along the clearance 24 between the drive shaft and the passage wall, flowing 33 through the drive shaft housing 19.

The flow 33 then reaches the cutlass bearings 22, wherein the filtered water passes therethrough, cooling and lubricating said bearings at a pressure and flow rate proportional to the rotation of the impeller 15, thereby providing greater flow pressure and volume when the cutlass bearings 22 require greater cooling and lubrication, effectively supporting the bearings. The flow 33 of water then lastly passes through the bearings 22 into the thrust stream 16, and out of the system. Pressure relief aperture B of, for example, 1/16" may be provided to prevent fluid 33 overpressurization of the shaft housing.

The shaft drive shaft passage 4 is about, for example 1/16", but could be 1/32" to 1/4" larger in radial size than the drive shaft, providing a clearance which would be adequate for a flow of fluid therethrough for cooling purposes. FIG. 2 further illustrates the flow of fluid through the apertures 29 or intake port, into flow chamber 28, which may past through, for example, a stainless steel wear ring with a screened section, filtering the flow, or other filtering means. The water next flows 31 through hose 27, to the T 26, wherein it is split to flow to a hose 34 to the engine, or to the passage 25 leading to the drive shaft passage, wherein the water flows 33 therethrough.

Lastly, FIG. 2 illustrates the flow of exhaust gas and spent cooling water 36 through exhaust hose 35, wherein said exhaust is directed 36 via a housing passage to the thrust flow, quieting same.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. The method of lubricating and cooling a cutlass bearing supporting a drive shaft adjacent to an impeller, in an impeller cavity formed in a housing, in a tunnel jet drive marine propulsion system, comprising the steps of:

a. rotating said impeller, generating positive pressure in the form of a water stream in said impeller cavity;

b. utilizing said positive pressure generated by said rotating impeller to direct a portion of said water stream through an intake passage formed in said housing in the vicinity of said impeller chamber;

c. filtering said directed water stream of particulate;

d. directing said filtered water stream about a drive shaft assembly enclosed by said housing, said drive shaft assembly driving said impeller, said water stream directed about said drive shaft assembly via a water entry passage formed in said housing, said water entry passage situated such that said cutlass bearing is between said water entry passage and said impeller;

e. directing said filtered water about said enclosed drive shaft; and f. directing said filtered water through said cutlass bearing.

2. The method of claim 1, wherein said drive shaft assembly has first and second ends, said second end having situated therein said cutlass bearing, said method further comprising the steps of providing a mechanical seal as said first end of said drive shaft assembly.

3. The method of claim 1, wherein said housing is of a unitary, one piece structure fabricated via the lost foam cast method.

* * * * *